US006627828B1

(12) United States Patent
McCartney

(10) Patent No.: US 6,627,828 B1
(45) Date of Patent: Sep. 30, 2003

(54) GAS APPLIANCE VALVE AND SWITCH ACTUATOR ASSEMBLY INCLUDING KNOB ACTUATED DEPRESSIBLE IGNITION CONTACTOR

(75) Inventor: Edward O. McCartney, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 242 days.

(21) Appl. No.: 09/655,856

(22) Filed: Sep. 6, 2000

(51) Int. Cl.[7] ..... H01H 9/06
(52) U.S. Cl. ..... 200/61.86; 431/256
(58) Field of Search ..... 200/61.86; 432/254–257

(56) References Cited

U.S. PATENT DOCUMENTS

| | | | | |
|---|---|---|---|---|
| 3,884,413 A | | 5/1975 | Berquist | 236/154 A |
| 3,971,904 A | * | 7/1976 | Ward | 200/61.86 X |
| 4,002,866 A | * | 1/1977 | Ward | 200/453 |
| 4,019,855 A | | 4/1977 | Camillo | 431/256 |
| 4,110,065 A | | 8/1978 | Fujiwara | 431/255 |
| 4,249,047 A | * | 2/1981 | Huff et al. | 200/61.86 |
| 4,371,764 A | | 2/1983 | Runion | 200/61.86 |
| 4,843,198 A | | 6/1989 | Lichtenberger | 200/61.86 |
| 5,017,745 A | | 5/1991 | Lichtenberger | 200/307 |
| 5,129,283 A | | 7/1992 | Koehler | 74/553 |
| 5,384,442 A | | 1/1995 | Danner | 200/556 |
| 5,406,041 A | * | 4/1995 | Hahn et al. | 200/61.86 |
| 5,525,771 A | * | 6/1996 | Lund | 200/61.86 |

* cited by examiner

*Primary Examiner*—J. R. Scott
(74) *Attorney, Agent, or Firm*—Diedericks & Whitelaw, PLC

(57) ABSTRACT

A gas flow control and igniter switch assembly for a gas appliance includes a valve body having a stem, an igniter activating switch and a knob, wherein the igniter is activated upon depressing of the knob a predetermined distance. The igniter switch is preferably constituted by a multi-piece outer casing within which is mounted multiple igniter contacts, an electrical connector, and an activating member. The activating member carries the electrical connector and is biased to a position which maintains an electric circuit to the igniter open. The multi-piece outer casing is adapted to be snap-fittingly secured together and mounted about the stem of the valve. Preferably, the stem extends freely through the outer casing but press-fittingly receives the activating member such that the activating member moves in axial unison with the stem. A knob is employed for rotating the stem to regulate the flow of gas from an inlet to an outlet of the valve, while also permitting the valve stem to be depressed in order to initiate a sparking operation at an electrode for a respective gas burner of the appliance.

20 Claims, 7 Drawing Sheets

GAS APPLIANCE VALVE AND SWITCH ACTUATOR ASSEMBLY INCLUDING KNOB ACTUATED DEPRESSIBLE IGNITION CONTACTOR

BACKGROUND OF THE INVENTION

1. Field of the Invention

The present invention pertains to the art of gas appliances and, more particularly, to a switching device, incorporated in an overall gas flow control valve assembly, for activating an igniter for the flow of gas.

2. Discussion of the Prior Art

In a gas appliance, such as a range, it is common to provide a plurality of gas burner elements to which gas is supplied through respective flow control valves. Typically, each valve is provided with a knob which is exposed at the front of the appliance and can be rotated to regulate the flow of gas to a respective burner. In years past, a pilot light was provided to ignite the regulated flow of gas. In order to avoid the need to maintain a constantly lit pilot light, it has now become commonplace to provide an electric ignition system for the gas, with the ignition system including an electrode provided at the burner element and an electric switch controlled by movement of the knob to develop a series of sparks at the electrode. In general, when the knob is rotated, an initial high gas flow/ignition position is reached wherein a cam inside the switch causes contacts to become electrically engaged. Once the gas is ignited, the user can rotate the knob further to terminate the sparking operation and to establish a desired flame setting.

With this arrangement, it is possible for the user of the appliance to release the knob while still in the initial position such that the igniter continues to unnecessarily spark. This circumstance is considered disadvantageous from various standpoints, including operational and economic inefficiencies. In addition, it would be advantageous to be able to initiate a sparking operation with the control knob in various rotational locations instead of only at an initial, rotational position.

Based on the above, there exists a need in the art for a valve and igniter switch assembly which is designed to automatically cease a sparking operation whenever an associated control knob is released. In addition, there exists a need for a valve and igniter switch assembly which will enable a user to initiate a sparking operation without requiring the knob to be in a specific operational position.

SUMMARY OF THE INVENTION

The present invention is directed to a gas flow control and igniter switching assembly for a gas appliance including a rotary valve body from which projects a control stem along an axially extending axis, with the stem being both rotatable about the axis to control a flow rate of gas through the valve and, preferably, shiftable in the axial direction relative to the valve body. In accordance with the most preferred embodiment of the invention, the switch portion of the assembly includes first and second contacts which become electrically engaged with each other upon shifting of the stem in the axial direction, substantially independent of the rotary angular position of the stem relative to the valve body.

In accordance with a preferred embodiment of the invention, the switch portion of the assembly includes an outer casing formed from first and second pieces which are snap-fittingly interconnected. The first and second contacts are seated in respective portions of the first casing piece. Interposed between the casing pieces is an activation member which is generally in the form of a disk. Attached to the activation member is an electrical connector which, in the most preferred form of the invention, is constituted by a spring member that abuts the first casing piece and biases the activation member towards the second casing piece. The first and second casing pieces, as well as the activation member, are provided with respective holes through which the stem passes. The hole in the first casing piece actually extends about a sleeve projecting from the valve body in order to non-rotatably mount the first casing piece to the valve body, while the stem is frictionally held in the bore of the activation member. A control knob is attached to the end of the stem for selectively rotating and axially shifting the stem.

With this arrangement, the activation member shifts axially in unison with the stem and relative to the contact members. Depressing the knob causes the activation member to electrically interconnect the contacts to initiate a sparking operation for igniting a supply of gas flowing through the valve. Since the activation member is biased away from the first casing piece and the contacts, releasing the control knob will automatically cause the electrical connector to become spaced from the contacts to terminate the sparking operation. The particular configuration of the contacts and the electrical connector establishes a wide range of angular positions for the knob in which the sparking will occur upon depression of the stem. In the most preferred form of the invention, the sparking can be activated throughout substantially the entire range of rotation of the stem.

Additional objects, features and advantages of the invention will become more fully apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
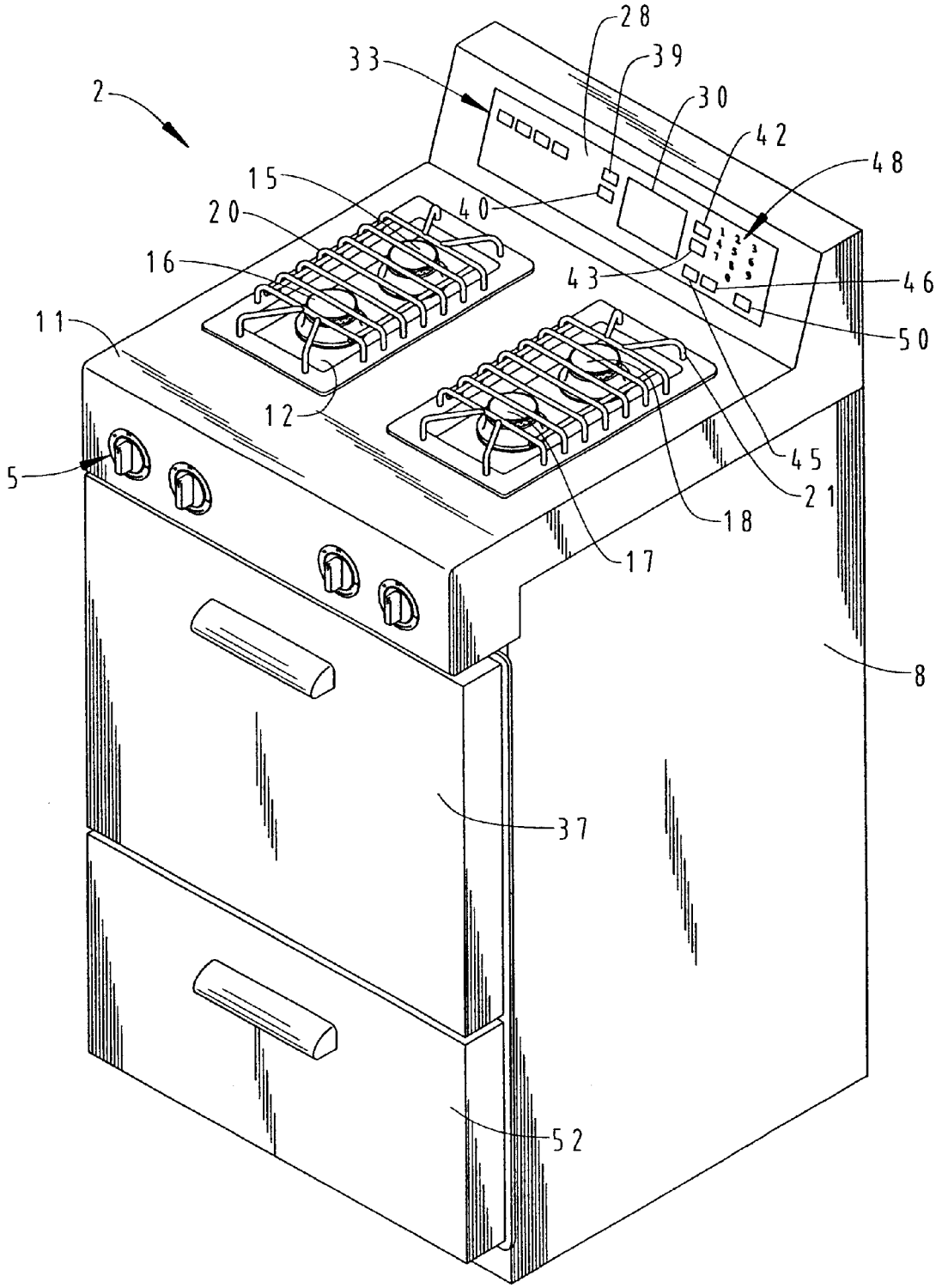
FIG. 1 is perspective view of a gas range incorporating the valve and igniter switch assembly of the invention.

With initial reference to FIG. 1, a gas range 2 is depicted incorporating the valve and igniter switch assembly 5 of the present invention. As shown, gas range 2 includes a cabinet 8 and a cooktop 11. Cooktop 11 is formed with various recessed wells 12 within which are mounted gas burner elements. Extending over gas burner elements 15, 16 and 17, 18 are respective grates 20 and 21. In general, each of the gas burner elements 15–18 are preferably of the sealed type and is adapted to receive a gas/air mixture which flows through circumferentially spaced ports and which is ignited through the use of a spark electrode. As this structure is widely known in the art and not considered part of the present invention, it will not be discussed in further detail here. Instead, reference is made to U.S. Pat. No. 5,152,276 directed to such a known type of seal gas burner assembly, with the disclosure in this patent being incorporated herein by reference.

Gas range 2 is also shown to include a control panel 28 that includes a display 30, a row of function buttons 33 which are used to select a desired cooking operation within an oven located behind door 37 of gas range 2. For instance, the first row of buttons 33 could be used to select between baked, broiled, clean and keep warm modes of operation. Control panel 28 is also shown to include a light button 39, a cancel button 40, an auto-set button 42 used in programming gas range 2, a timer button 43, cook and stop time buttons 45 and 46, a numeric array 48 and a clock setting button 50. In general, the arrangement and operation of control panel 28 is merely presented here for the sake of completeness and is not an aspect of the present invention. Also for the sake of completeness, gas range 2 is shown to include a lower drawer 52 which can be used to hold pans and the like in a manner known in the art.

Figure 2:
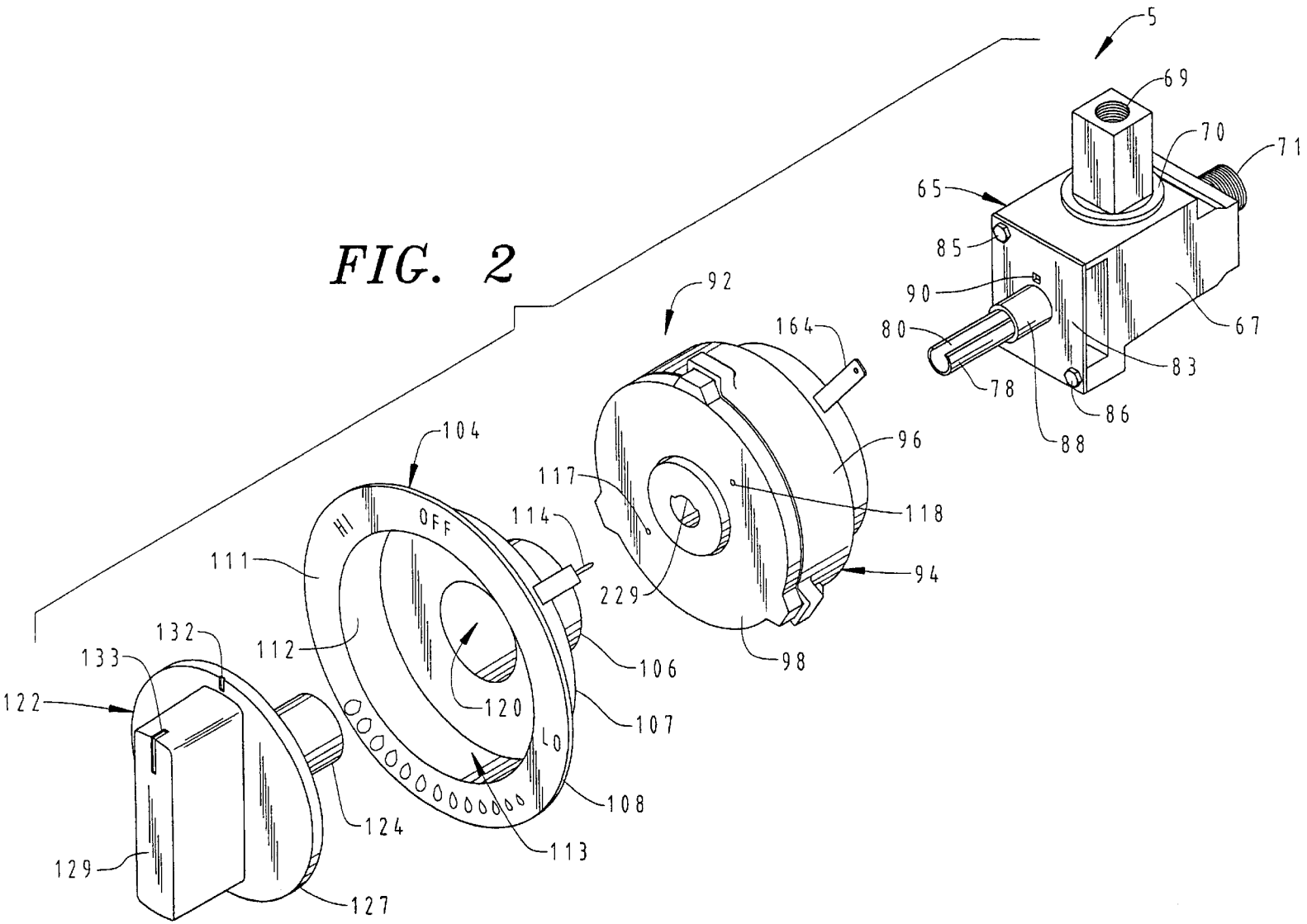
FIG. 2 is an exploded view of the valve and switch assembly constructed in accordance with the present invention.

In general, gas range 2 is depicted to illustrate an exemplary cooking device to which the valve and igniter switch assembly 5 of the invention can be applied. As will become more fully evident below, the valve and igniter switch assembly 5 of the invention can be used in connection with various different types of appliances and in other environments wherein it is desired for a user to control a flow of gas and the ignition of that gas. Reference will now be made to FIG. 2 in describing the main components of the valve and igniter switch assembly of the invention.

As shown in FIG. 2, valve and igniter switch assembly 5 includes a valve unit 65 having a body 67 provided with a gas inlet 69, about which is provided a seal 70, and a gas outlet 71. Although not shown, valve body 67 houses a rotary valve that is interconnected to a stem 78 of valve unit 65. Actually, this basic structure and operation of valve unit 65 is known in the art wherein stem 78 can be rotated to cause movement of an internal valve element in order to adjust the flow rate of gas supplied to inlet 69, through body 67 and gas outlet 71. As shown, stem 78 preferably includes an elongated cut-out portion 80. Stem 78 is preferably supported on body 67 through the use of a plate 83 that is attached with threaded fasteners 85 and 86 to body 67. Plate 83 includes a central sleeve portion 88, through which stem 78 projects, and a hole 90. Again, aside from the incorporation of valve unit 65 in the overall valve and igniter switch assembly 5 of the invention, the actual construction and operation of valve unit 65 is known in the art and, in fact, is utilized in various gas ranges currently available on the market today.

FIG. 2 also shows a switch assembly 92 constructed in accordance with the present invention. In accordance with the most preferred embodiment, switch assembly 92 includes an outer casing 94 which is defined by a first piece 96 and a second piece 98. Details of switch assembly 92 will be discussed more fully below with particular reference to FIGS. 7–9. Valve and igniter switch assembly 5 also includes an indicator cover 104 including first, second and third diametric portions 106–108. Third diametric portion 108 includes a face portion 111 that is preferably provided with various indicia used to aid a user in establishing a desired flow of gas through valve unit 65. As shown, face portion 111 includes off, high and low positions, as well as representations of reduced flame sizes between the high and low positions. Third diametric portion 108 is interconnected with second diametric portion 107 through a side wall 112 such that indicator cover 104 defines a recessed area 113. Indicator cover 104 is also preferably provided with a pair of diametrically opposed projections, one of which is indicated at 114, which are adapted to be received in respective alignment holes 117 and 118 formed in second piece 98 of outer casing 94 of switch assembly 92. Indicator cover 104 also includes a central bore 120.

Finally, valve and igniter switch assembly 5 includes a knob 122. Although knob 122 can take various forms, the preferred embodiment shown illustrates the presence of a sleeve portion 124, a disk portion 127 and a handle portion 129. Disk and handle portions 127 and 129 are provided with alignment markings 132 and 133 which are adapted to cooperate with the indicia provided on indicator cover 104.

Figure 3:
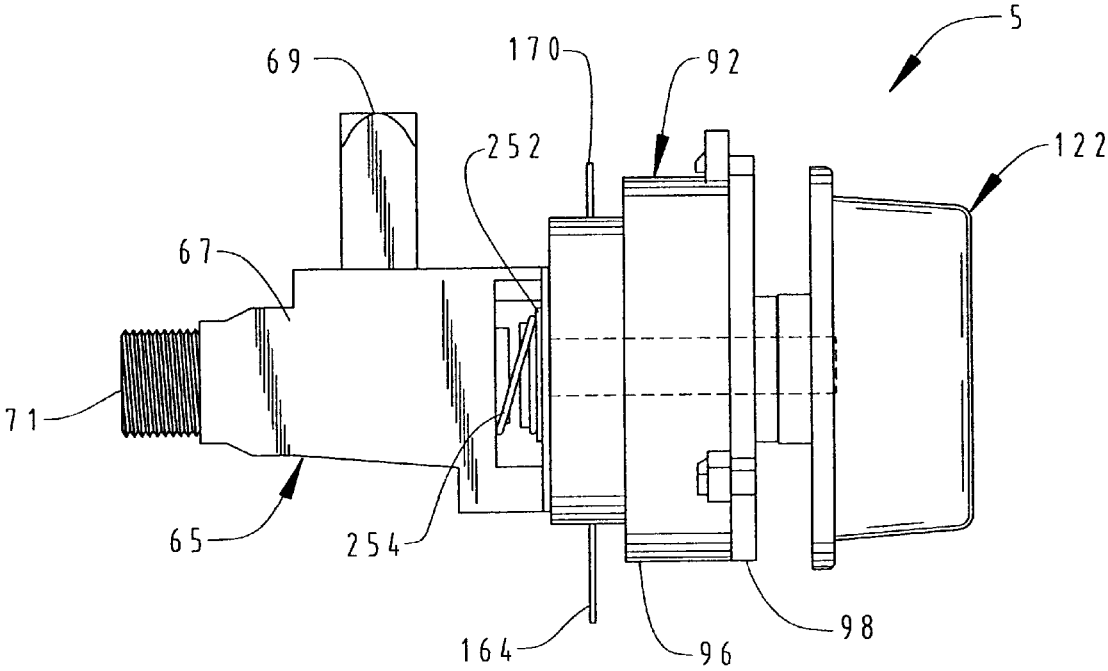
FIG. 3 is a side view of the valve and switch assembly shown in an off state.
Figure 4:
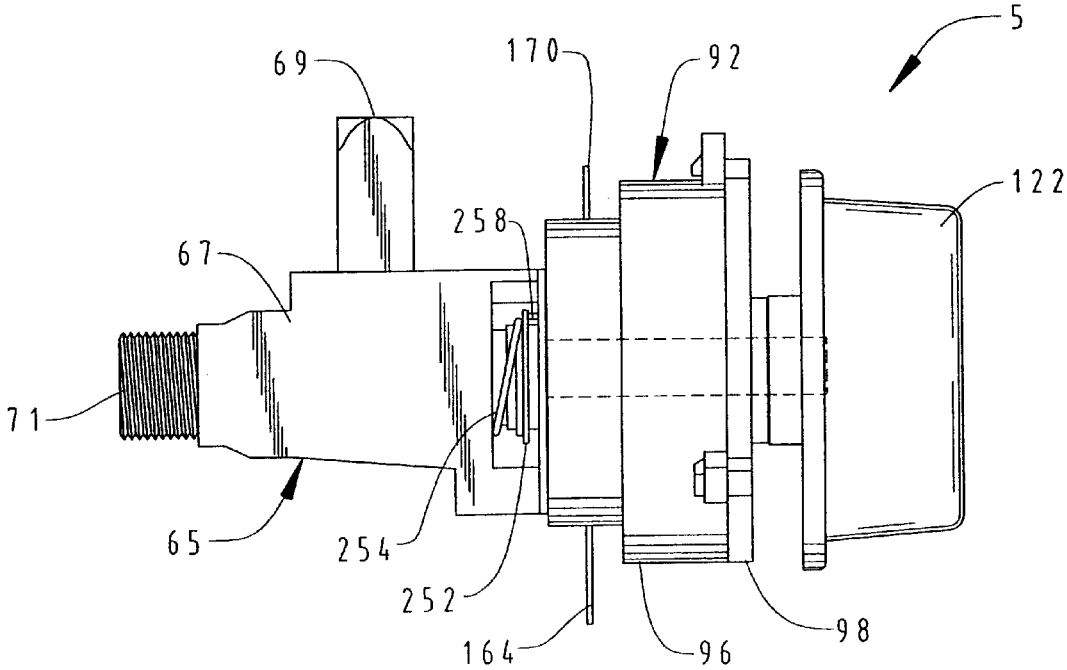
FIG. 4 is a side view, similar to that of FIG. 3, depicting a control knob and actuating stem of the valve and switch assembly in a partially depressed, igniter activating position.
Figure 5:
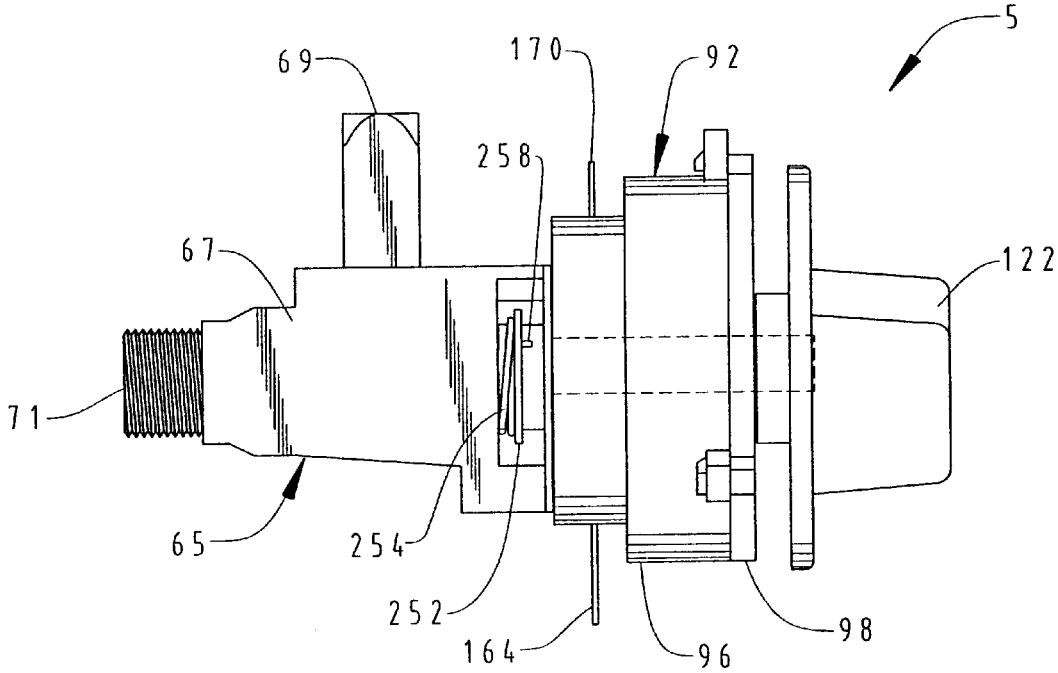
FIG. 5 is a side view, similar to that of FIG. 4, but depicting the control knob and actuating stem in a fully depressed and partially rotated position.
Figure 6:
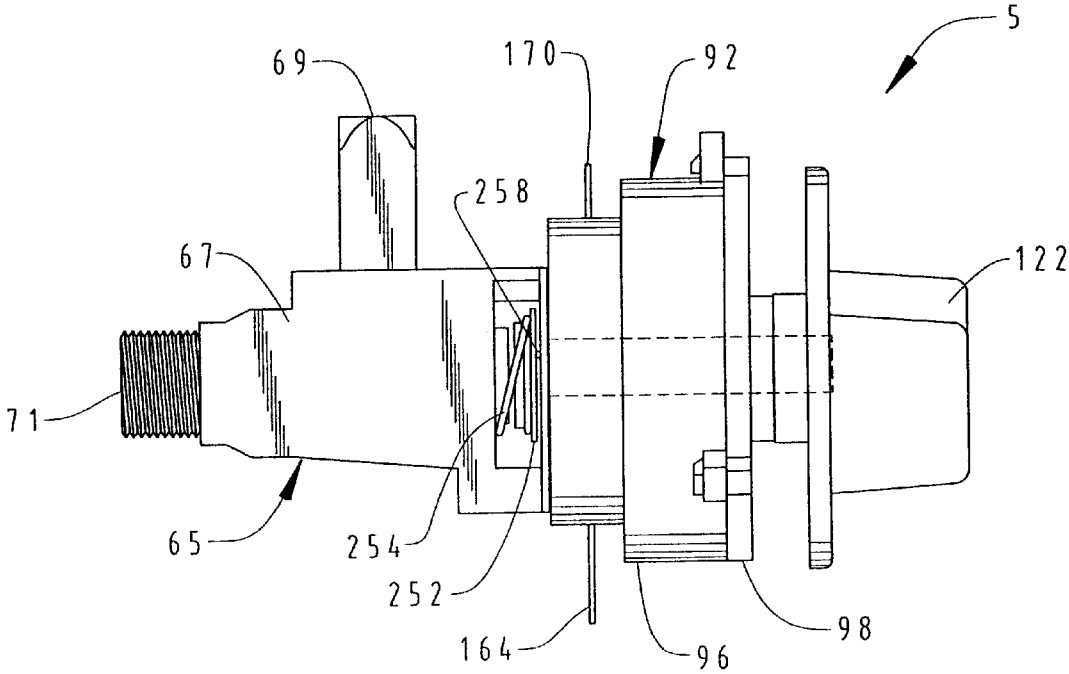
FIG. 6 is a side view, similar to FIG. 5, but depicting the valve and switch assembly in a normal operating position.

FIG. 3 illustrates an assembled state for valve and igniter switch assembly 5. In this figure, indicator cover 104 has not been included for clarity purposes. The actual mounting of the various components of valve and igniter switch assembly 5 will become more fully apparent below after detailing the preferred construction of switch assembly 92. However, at this point, it should be noted that interconnecting a valve unit, switch assembly, indicator cover and control knob for use in regulating a flow of gas and controlling the activation of a spark igniter is known in the art. Therefore, it is the particular construction and operation of switch assembly 92 in this overall arrangement which distinguishes the present invention from the known prior art.

Figure 7:
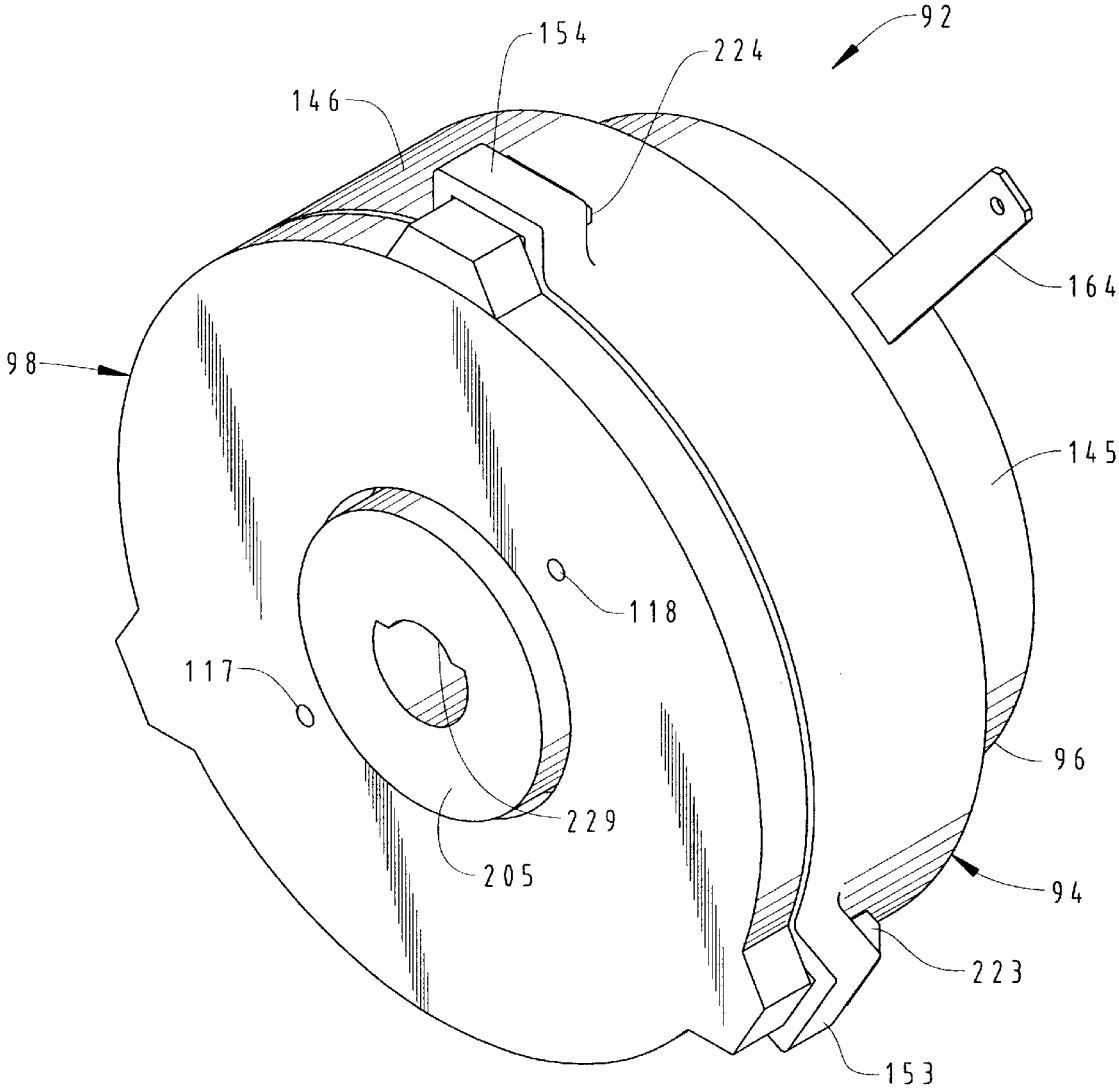
FIG. 7 is an enlarged perspective view of the switching device incorporated in the valve and switch assembly of FIG. 2.
Figure 8:
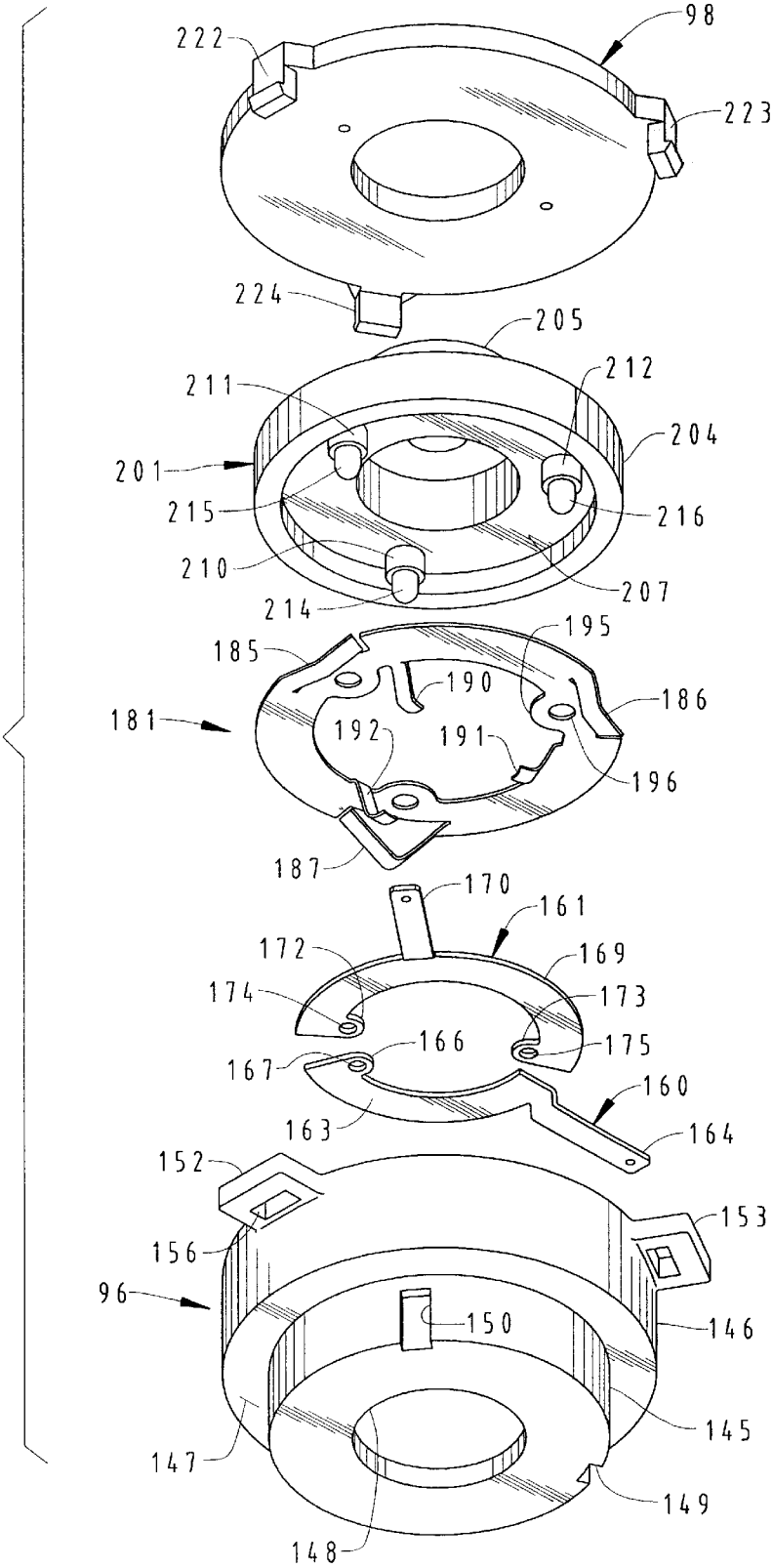
FIG. 8 is an exploded view of the switching device of FIG. 6.
Figure 9:
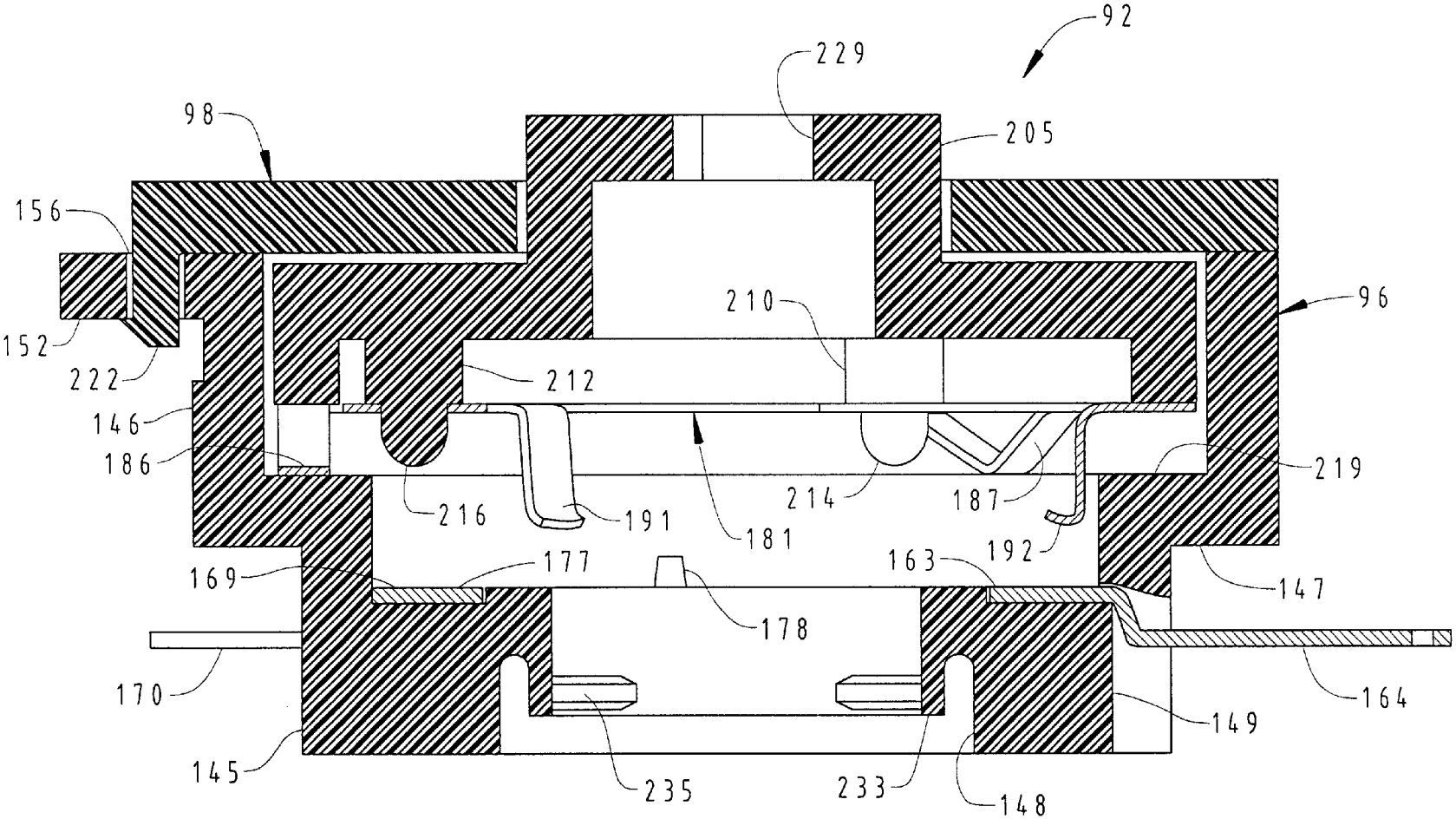
FIG. 9 is a cross-sectional view of the switching device of FIG. 7.

Based on the above, reference will now be made to FIGS. 7–9 in describing the preferred construction and operation of switch assembly 92. As shown, first piece 96 of outer casing 94 includes a first outer diametric portion 145 which is connected to a second outer diametric portion 146 through a radial portion 147. First diametric portion 145 includes a central opening 148 and a pair of peripherally spaced slots 149 and 150. At second diametric portion 146, first piece 96 is provided with a plurality of radial protrusions 152–154, each of which is provided with a respective axial opening 156. Switch assembly 92 also includes first and second contacts 160 and 161. More specifically, first contact 160 preferably includes an arcuate segment 163 and a linear segment 164 which defines a first electrical terminal. First contact is also formed with a tab 166 that is provided with an aperture 167. The second contact 161 is defined by an arcuate segment 169 and a linear segment 170 that defines a second electrical terminal. The second contact 161 is also provided with a pair of spaced tabs 172 and 173 each of which includes a respective aperture 174 and 175. As perhaps best shown in FIG. 8, first piece 96 of outer casing 94 is provided with an annular groove 177 along with various spaced posts, one of which is indicated at 178. First and second contacts 160 and 161 are positioned within respective portions of annular groove 177, with apertures 167, 174 and 175 each receiving a respective post 178, and with linear segment 164 of first contact 160 projecting through slot 149, while linear segment 170 of second contact 161 projects through slot 150. In this manner, first and second contacts 160 and 161 are seated within first piece 96 of outer casing 94. When seated, first and second contacts 160 and 161 do not engage each other. Linear segments 164 and 170 are adapted to be respectively interconnected to an incoming electrical source and to an, electrode of a respective gas burner element 115–118. Therefore, with this arrangement, power to the electrode for initiating a sparking operation can be performed by electrically interconnecting first and second contacts 160 and 161.

Switch assembly 92 further includes an electrical connector 181 which, in the most preferred embodiment, takes the form of a metal spring having an annular body 183. Stamped from annular body 183 are a plurality of angled, resilient biasing legs 185–187. Annular body 183 also includes a plurality of contact legs 190–192 which are generally L-shaped in side-view. As shown, biasing legs 185–187 are preferably arranged at an outer peripheral portion of annular body 183, while contact legs 190–192 are arranged at an inner peripheral portion. Arranged preferably radially inwardly of each of the various biasing legs 185–187 is a respective protrusion 195 that is provided with a through hole 196.

Switch assembly 92 also includes an activating member 201 having a first diametric portion 204 and a second diametric portion 205 interconnected by a radial section 207. Projecting axially from radial section 207, within the confines of first diametric portion 204, are various bosses 210–212, each of which includes a respective projecting post 214–216. Each post 214–216 is adapted to be frictionally received within a through hole 196 of a respective protrusion 195 such that electrical connector 181 is seated upon bosses 210–212 and frictionally retained within the confines of first diametric portion 204 of activating member 201. First diametric portion 204 of activating member 201 is actually received within the confines of second diametric portion 146 of first casing piece 96 as clearly shown in FIG. 9. In this position, biasing legs 185–187 rest upon a ledge 219 defined by radial portion 147. With this arrangement, biasing legs 185–187 tend to maintain the terminal ends of contact legs 190–192 at a position spaced from arcuate segments 163 and 169 of first and second contacts 160 and 161 as shown in FIG. 9. However, depression of activating member 201 relative to first and second pieces 96 and 98 of outer casing 94 through second diametric portion 205 will cause biasing legs 185–187 to deflect which, in turn, will enable contact legs 190–192 to abut a respective one of arcuate segments 163 and 169. When in this position, an electrical circuit between first and second contacts 160 and 161 is completed.

Second casing piece 98 of switch assembly 92 is provided with various outer peripheral tabs 222–224 which, upon seating of first and second contacts 160 and 161 and the positioning of both electrical connector 181 and activating member 201 within first casing piece 96, can each be aligned with the opening 156 providing in a respective protrusion 152–154 in order to snap-fittingly interconnect first and second pieces 96 and 98 while containing first and second contacts 160 and 161, electrical connector 181 and activating member 201 therebetween. FIGS. 2, 7 and 9 therefore show the fully assembled condition for switch assembly 92, the components of which, in the preferred embodiment, are formed of molded plastic, with the exception of metallic contacts 160, 161 and electrical connector 181.

As perhaps best evidenced with reference to FIGS. 2 and 3, when switch assembly 92 is positioned upon stem 78, a portion of stem 78 projects from second cover piece 98 in order to enable the mounting of knob 122 upon stem 78. Second piece 98 is provided with a non-circular hole 229 (see FIGS. 2 and 7) which cooperates with the shape of stem 78 given the presence of elongated cut-out portion 80 wherein activating member 201 is frictionally retained by stem 78 for concurrent rotational and axial movement. A similar interconnection is made between sleeve 124 of knob 122 and stem 78. On the other hand, stem 78 extends freely through central opening 148 of first casing piece 96. More particularly, central opening 148 is defined, at least in part, by a resilient extension 233 (see FIG. 9) which has formed thereabout various radially inwardly projecting and circumferentially spaced mounting segments 235. With this construction, when switch assembly 92 is placed over stem 78, first casing piece 96 is tightly mounted about sleeve 88. Although not shown, first casing piece 96 could be formed with an indentation to receive the head of one or more of fasteners 85 and 86 to further aid in locating switch assembly 92 for non-rotational movement relative to valve body 67. In any event, outer casing 94 is fixed against rotation relative to valve unit 65, along with indicator cover 104 and first and second contacts 160 and 161. On the other hand, activating member 201 and electrical connector 181 rotate in unison with stem 78 as controlled by the manual manipulation of knob 122.

FIGS. 3–6 show various operational positions of the valve and igniter switch assembly 5 of the present invention. As indicated above, FIG. 3 simply illustrates an assembled condition wherein the valve unit 65 is closed to prevent the flow of gas from inlet 69 towards outlet 71. Again, it should also be noted that indicator cover 104 is not shown in these figures for clarity purposes. In a manner known in the art, stem 78 actually terminates within valve body 67 in a plate 252 which is connected by a spring 254 to the actual rotary valve element within body 67. Again, this particular operation for valve unit 65 is known in the art. However, this arrangement enables a detent configuration to exist which requires a depression of knob 122 and a corresponding axial shifting of stem 78 to the position shown in FIG. 5 in order for knob 122 to be rotated out of the "off" position. That is, plate 252 is formed with a tab 258 which is received within hole 90 in the position of FIG. 3 and stem 78 must be depressed a distance to clear tab 258 from hole 90. In general, stem 78 can shift in the order of 3/32" from the FIG. 3 position to the FIG. 5 position. Prior to reaching the FIG. 5 position, contact legs 190–192 will engage arcuate segments 163 or 169 such that electrical current is supplied to the electrode at a respective gas burner element 15–18. For instance, contacts 160 and 161 are electrically connected at the position shown in FIG. 4, e.g., upon a 2/32" (0.16 cm) shifting of stem 78. Therefore, whenever knob 122 is axially depressed to at least the position shown in FIG. 4, activating member 201 will be shifted relative to outer casing 94 of switch assembly 92 by the deflection of biasing legs 185–187 to enable contact legs 190–192 to engage a respective arcuate segment 163, 169 of first and second contacts 160 and 161. In this position, first and second contacts 160 and 161 will be electrically interconnected to initiate a sparking operation at the respective gas burner element 15–18. Once the user releases knob 122 such that the knob 122 again shifts to the axial position shown in FIG. 6 wherein stem 78 remains deflected only a slight amount, such as 1/32" (0.08 cm), electrical connector 181 will no longer complete a circuit with first and second contacts 160 and 161. Although knob 122 and stem 78 can be continually rotated, such as through approximately 270°, in order to select a desired gas flow rate and corresponding flame size for cooking purposes, the ignition circuit will not be closed unless stem 78 is further depressed through knob 122. In the FIG. 6 position, tab. 258 preferably extends in a groove (not shown) formed in a rear portion of plate 83, with the groove leading from hole 90 to define the permissible extent of travel for knob 122.

It should be readily apparent that, unlike the prior art which established a predetermined igniter position between "off" and "high" settings, the igniter circuit associated with the present invention can be closed at a wide range of positions by simply depressing of knob 122 a predetermined extent. The axial deflection of activating member 201 occurs, in the most preferred embodiment, since non-circular hole 229 receives stem 78 in a generally press-fit manner such that any axial shifting of stem 78 will result in a corresponding axial shifting of activating member 201. In any event, it should also be noted that it is not possible for a user of gas range 2 to inadvertently leave valve and igniter switch assembly 5 in a continued sparking position. In the most preferred form of the invention, the use of three contact legs 190–192 enables the igniter to be activated regardless of the angular position of knob 122. Of course, it would be possible to limit the particular angular range (approximately 270° in the preferred embodiment), such as by simply limiting the length of arcuate segments 163 and 169, the number of contact legs 190–192 or the like. The manner in which switch assembly 92 can be pre-assembled through the snap-fit interconnection of first and second pieces 96 and 98 of outer casing 94 advantageously enables pre-assembling of switch assembly 92 for subsequent interconnection with the various other components of valve and igniter switch assembly 5. Any maintenance of switch assembly 92 is also enhanced versus the prior art wherein switch housings are typically riveted or otherwise sealed in a manner which would require the entire switching unit to be replaced following a detected malfunction.

Based on the above, it should be recognized that the valve and igniter switch assembly of the present invention provides an advantageous igniter control arrangement in a simple and effective manner. However, although described with respect to a preferred embodiment of the invention, it should be readily understood that various changes and/or modifications can be made to the invention without departing from the spirit thereof. For instance, although first and second contacts 160 and 161 are fixed relative to first casing piece 94 and are adapted to electrically linked by connector 181, other electrical arrangements including providing one of the contacts on activating member 201 would also be possible. Furthermore, although it is preferred to have activating member 201 both rotate and axially shift in unison with stem 78 and knob 122, it would be possible to simply have activating member 201 axially shift with knob 122, such as by having sleeve 124 of knob 122 directly abut a portion of activating member 201 to cause the desired axial shifting. In any event, the invention is only intended to be limited by the scope of the following claims.

I claim:

1. A combination valve and switch assembly adapted to be used in regulating both a flow and ignition of gas in an appliance comprising:

a valve assembly including a body, having a gas inlet and a gas outlet, and a valve stem projecting from the body along an axis extending in an axial direction, said stem being both rotatable about the axis to control a flow rate of gas from the gas inlet to the gas outlet and shiftable in the axial direction relative to the body;

a knob attached to the stem, said knob being adapted to be selectively turned for rotating the stem and depressed for axially shifting the stem relative to the body; and switching means for activating an igniter for the flow of gas upon depressing of the knob a predetermined distance.

2. The assembly according to claim 1, wherein the switching means is interposed between the body of the valve assembly and the knob.

3. The assembly according to claim 2, wherein the switching means includes an outer casing and an inner portion, said inner portion being axially shiftable relative to the outer casing, said outer casing being fixed relative to the body of the valve assembly.

4. The assembly according to claim 3, wherein the inner portion is connected for movement with said stem.

5. The assembly according to claim 4, wherein the valve assembly includes a sleeve portion, said stem projecting axially through the sleeve portion, said outer casing being mounted to the body of the valve assembly about the sleeve portion.

6. The assembly according to claim 4, wherein the inner portion of the switching means includes a central section provided with an aperture, said stem projecting through the aperture.

7. The assembly according to claim 6, wherein the inner portion constitutes an activating member which is press-fit on the stem.

8. The assembly according to claim 7, wherein the activating member includes a plurality of spaced contact legs.

9. The assembly according to claim 7, wherein the activating member comprises a spring wherein the activating member includes a plurality of biasing legs which abut against the outer casing to bias the inner portion in a direction away from the body of the valve assembly.

10. The assembly according to claim 2, wherein the outer casing includes first and second casing pieces which are snap-fittingly interconnected.

11. A combination valve and switch assembly adapted to be used in regulating both a flow and ignition of gas in an appliance comprising:

a valve assembly including a body, having a gas inlet and a gas outlet, and a stem projecting from the body along an axis extending in an axial direction, said stem being adapted to be rotated about the axis to control a flow rate of gas from the gas inlet to the gas outlet;

a knob attached to the stem, said knob being adapted to be grasped by a user and turned for selectively rotating the stem, said knob further being shiftable axially relative to the body of the valve assembly; and a switching device including an outer casing fixed relative to the body of the valve assembly and an activating member which is connected for both axial and rotative movement with the knob relative to the body of the valve, wherein axial shifting of the activating member a predetermined amount closes an igniter circuit for the flow of gas.

12. A combination valve and switch assembly adapted to be used in regulating both a flow and ignition of gas in an appliance comprising:

a valve assembly including a body, having a gas inlet and a gas outlet, and a stem projecting from the body along an axis extending in an axial direction, said stem being adapted to be rotated about the axis to control a flow rate of gas from the gas inlet to the gas outlet, wherein the valve assembly includes a sleeve portion, said stem projecting axially through the sleeve portion;

a knob attached to the stem, said knob being adapted to be grasped by a user and turned for selectively rotating the stem, said mob further being shiftable axially relative to the body of the valve assembly; and a switching device including an outer casing fixed relative to the body of the valve assembly, with said outer casing being mounted to the body of the valve assembly about the sleeve portion, and an activating member which is connected for axial movement with the knob relative to the body of the valve, wherein axial shifting of the activating member a predetermined amount closes an igniter circuit for the flow of gas.

13. The assembly according to claim 11, further comprising: a pair of contacts mounted within the outer casing, said contacts being adapted to be electrically interconnected upon shifting of the activating member the predetermined axial distance.

14. The assembly according to claim 11, wherein the activating member includes a central section provided with an aperture, said stem projecting through the aperture.

15. A combination valve and switch assembly adapted to be used in regulating both a flow and ignition of gas in an appliance comprising:

a valve assembly including a body, having a gas inlet and a gas outlet, and a stem projecting from the body along an axis extending in an axial direction, said stem being adapted to be rotated about the axis to control a flow rate of gas from the gas inlet to the gas outlet;

a knob attached to the stem, said knob being adapted to be grasped by a user and turned for selectively rotating the stem, said knob further being shiftable axially relative to the body of the valve assembly; and a switching device including an outer casing fixed relative to the body of the valve assembly and an activating member which is press-fit on the stem so as to be connected for axial movement with the knob relative to the body of the valve, said activating member including a central section provided with an aperture, said stem projecting through the aperture, wherein axial shifting of the activating member a predetermined amount closes an igniter circuit for the flow of gas.

16. The assembly according to claim 11, wherein the outer casing includes first and second casing pieces which are snap-fittingly interconnected.

17. A method of regulating both the flow and ignition of gas in an appliance comprising:

regulating a flow rate of gas from an inlet to an outlet of a valve unit by rotating an axially extending stem of the valve unit; and activating an igniter for the flow of gas by manually depressing a knob, attached to the stem, a predetermined axial distance in order to axially deflect an activating member secured for rotation with the stem.

18. The method according to claim 17, further comprising:

permitting the knob to be rotated between high, low and off positions for the flow of gas; and permitting activation of the igniter upon depressing the knob throughout substantially an entire range of travel of the knob between at least the high and low positions.

19. The method according to claim 17, further comprising:

axially deflecting the activating member, which is press-fit upon the stem, to electrically interconnect two contacts of an ignition circuit upon depressing the knob the predetermined distance.

20. The method according to claim 19, further comprising:

biasing the knob away from the valve unit through the activating member.

* * * * *